US005952777A

United States Patent [19]

Sugawara et al.

[11] Patent Number: 5,952,777

[45] Date of Patent: Sep. 14, 1999

[54] COLOR CATHODE RAY TUBE

[75] Inventors: Shigeru Sugawara, Kamisatomachi; Takahiro Hasegawa, Gyoda; Fumihito Suzuki, Fukaya, all of Japan

[73] Assignee: Kabushiki Kaisha Toshiba, Kawasaki, Japan

[21] Appl. No.: 08/962,443

[22] Filed: Oct. 31, 1997

[30] Foreign Application Priority Data

Oct. 31, 1996 [JP] Japan ..... 8-290180

[51] Int. Cl.[6] ..... H01J 29/88

[52] U.S. Cl. ..... 313/479; 313/477 R

[58] Field of Search ..... 313/479, 477 R, 313/477 HC

[56] References Cited

U.S. PATENT DOCUMENTS

| | | | |
|---|---|---|---|
| 4,374,344 | 2/1983 | Misono et al. | 313/479 |
| 4,602,187 | 7/1986 | Fischman et al. | 313/479 |
| 5,536,997 | 7/1996 | Van Hout | 313/479 |

FOREIGN PATENT DOCUMENTS

| | | |
|---|---|---|
| 0 512 627 A2 | 11/1992 | European Pat. Off. . |
| 53-10959 | 1/1978 | Japan . |
| 64-12449 | 1/1989 | Japan . |
| 5-205660 | 8/1993 | Japan . |
| 2 288 597 | 10/1995 | United Kingdom . |

*Primary Examiner*—Ashok Patel
*Attorney, Agent, or Firm*—Pillsbury Madison & Sutro LLP

[57] ABSTRACT

Disclosed is a color cathode ray tube including an in-line electron gun, in which a high-resistance film whose resistance R at T°C. has a resistance-temperature characteristic represented by $d(\text{Log } R(T))/dT \geqq -0.01$ at least at a temperature ranging from 20° C. to 40° C. and is approximately $5\times10^{13}\Omega$ or less at about 25° C. is formed on the inner wall of the neck.

4 Claims, 8 Drawing Sheets

COLOR CATHODE RAY TUBE

BACKGROUND OF THE INVENTION

The present invention relates to a color cathode ray tube and, more particularly, to stabilization of the potential of the neck inner wall in a cathode ray tube.

Generally, a color cathode ray tube comprises an envelope including a panel, a funnel, and a neck, an inner conductive film formed by adhesion from the inner wall of the funnel to the inner wall of the neck, and an electron gun arranged inside the neck and having a cathode provided in an end portion of the neck and a plurality of grids sequentially arranged from the cathode.

Usually, the electron gun focuses three parallel electron beams, one in the center and two on both sides, onto a fluorescent or phosphor screen and at the same time converges these electron beams. However, the convergence states of the three electron beams change with time due to the influence of a change in the inner wall potential of the neck. As a consequence, a problem such as color misregistration occurs. This problem is ascribed to penetration of the charged potential at the neck inner wall into the main lens of the electron gun, which influences the electric field and changes the trajectories of the two side electron beams. More specifically, the potential of the neck inner wall immediately after an anode voltage is applied reaches a certain fixed potential distribution state under the influence of, e.g., the inner conductive film or a convergence electrode of the electron gun. However, straying electrons generated in the neck collide against the charged neck inner wall to cause secondary electron emission from the neck and thereby gradually raise the neck potential. Consequently, the trajectories of the two side electron beams change to change their convergence states with time. This causes a so-called convergence drift and results in color misregistration.

To solve this problem, Jpn. Pat. Appln. KOKAI Publication No. 53-10959 has disclosed a proposal by which charging by secondary electrons is prevented by setting the surface specific resistance of the inner surface of neck glass to $10^{10}$ to $10^{14}$ $\Omega/m^2$. The use of soda-lime glass having a composition of $SiO_2$, $Na_2O$, $K_2O$, CaO, or MgO is described as an example of a resistance film.

Also, Jpn. Pat. Appln. KOKAI Publication No. 64-12449 has disclosed a proposal by which charging by secondary electrons is prevented by forming an insulating coating, having a surface resistance of $10^{12}$ to $10^{14}$ $\Omega/\square$ and a secondary electron emission ratio smaller than unity, on the inner surface of neck glass. $Cr_2O_3$ is exemplified as this insulating coating.

In addition, Jpn. Pat. Appln. KOKAI Publication No. 5-205660 has disclosed a proposal by which charging by secondary electrons is prevented by forming a glass enamel layer, containing particles of a substance whose secondary electron emission coefficient is smaller than unity and having a surface resistance of approximately $10^{10}$ to $10^{14}$ $\Omega/\square$, on the inner surface of neck glass. This publication describes that the enamel layer contains $Cr_2O_3$ particles.

Unfortunately, it is found by the experiments conducted by the present inventors that even if a high-resistance film such as disclosed in Jpn. Pat. Appln. KOKAI Publication No. 64-12449 or 5-205660 is formed on the inner wall of a neck, it is difficult to completely suppress a convergence drift, and discharge occurs in the tube to significantly lower the reliability of the tube.

For example, a convergence drift occurs when the neck temperature rises while the tube is in operation, and the resistance of the high-resistance film lowers with the increasing temperature to thereby raise the neck potential. Also, the reliability lowers when electrodes constituting the electrode gun in the tube emit electrons by an electric field due to the rise in the neck potential, thereby causing discharge in the tube. The convergence drift and the reliability when a high-resistance film is formed on the inner wall of a neck will be described in detail in order below.

FIG. 1 is a graph showing changes in the neck outer wall temperature with time when a 15" color display tube having a neck outer diameter of 22.5 mm (inner diameter=about 19.5 mm) is in operation. The portion subjected to temperature measurement is the outer wall of a neck where a main electron lens of an electron gun exists. The horizontal deflection frequency was 57 kHz, and the outside air temperature about 25° C. As is apparent from FIG. 1, the neck outer wall temperature starts sharply rising immediately after the operation is started and reaches about 35° C. in twenty minutes. After thirty minutes elapse, the neck outer wall temperature shows saturation and rises to about 45° C.

The inner wall of a neck having an outer diameter of 22.5 mm (inner diameter=about 19.5 mm) was coated with a $Cr_2O_3$ film about 15 mm in length along the axial direction of a tube. FIG. 2 is a graph showing the result of measurement of the resistance-temperature characteristic of the film in a vacuum of $10^{-3}$ Torr or less.

As can be seen from this characteristic, the resistance of the film decreases with the increasing temperature. FIG. 2 shows that the temperature dependence of resistance is about $d(\log R(T))/dT=-0.035$ assuming the resistance at T°C. is R(T), and the surface resistance decreases to about 3/10 when the temperature changes from 25° C. to 40° C.

The inner wall of a neck having an outer diameter of 22.5 mm (inner diameter=about 19.5 mm) was coated with the above-mentioned $Cr_2O_3$ film about 15 mm in length along the axial direction of a tube. A curve 701 in FIG. 3 represents the convergence drift characteristic of the tube. On the curve 701, the convergence is plotted on the ordinate against time plotted on the abscissa. The $Cr_2O_3$ film was formed with a length of about 15 mm along the tube axial direction so as to cover the gaps between grids forming a main focusing electron lens of an electron gun. To minimize charging of the neck by secondary electrons, the convergence measurement was performed by a cross hatch pattern by setting the total beam current of three electron beams to 5 $\mu$. After sixty minutes elapsed from the start of the operation of the tube, a change in the convergence was measured by supplying a total electron beam current of 450 $\mu$A in a non-measurement state, in order to measure the influence of the neck charging by secondary electrons. Note that the positive convergence direction corresponds to under convergence and the negative convergence direction over convergence. The outside air temperature during the measurement was about 25° C.

Also, a curve 702 in FIG. 3 represents a change in the electrical resistance with time of the $Cr_2O_3$ film described above. This is calculated from the change in the neck temperature with time shown in FIG. 1 and the temperature characteristic of the electrical resistance of the $Cr_2O_3$ film shown in FIG. 2. On the curve 702, the film resistance is plotted on the ordinate against time plotted on the abscissa.

As can be seen from the convergence drift characteristic indicated by the curve 701, the convergence immediately after the tube starts operating is an over convergence of about 0.3 mm. The convergence quickly decreases during the time interval from fifteen to twenty minutes and converges to almost zero after thirty minutes elapse. This indicates that the neck potential of the tube is charged to a comparatively low voltage immediately after the start of the operation and changes to a relatively high potential and stabilizes with passing of time. After sixty minutes elapse, the convergence remains unchanged even when a high beam current is supplied. That is, the neck potential is not changed by secondary electrons, indicating the effect of a high-resistance $Cr_2O_3$ film.

The convergence drift characteristic indicated by the curve 701 and the electrical resistance of the $Cr_2O_3$ film indicated by the curve 702 change with time in substantially synchronism with each This supports the fact that the convergence drift immediately after the tube starts operating is accounted for by a change in the electrical resistance of an antistatic film with time.

Compared to the resistance of an antistatic film at low temperatures, the resistance at high temperatures after fifteen to twenty minutes elapse sharply drops to about 3/10. Consequently, the film potential lowers to make the convergence drift in the direction of under convergence.

In the prior arts disclosed in Jpn. Pat. Appln. KOKAI Publication Nos. 64-12449 and 5-205660 as described above, charging of the neck potential by secondary electrons can be prevented. However, if a film having a large resistance-temperature characteristic such as a $Cr_2O_3$ film is used, the problem of a convergence drift newly arises due to heat generated by the tube. This convergence drift cannot be completely prevented. Also, the electrical conduction of soda-lime glass disclosed in Jpn. Pat. Appln. KOKAI Publication No. 53-10959 is ion conduction. Therefore, the temperature dependence of resistance is large, and this poses the problem of a convergence drift due to heat generation by the tube as in the case of $Cr_2O_3$.

In addition to the above problems, another serious problem arises when the inner wall of the neck is coated with a high-resistance film with a large resistance-temperature characteristic.

In the manufacturing process of a cathode ray tube, so-called spot knocking processing is generally performed by forcedly generating an intratube spark by applying a high voltage to the assembled cathode ray tube, in order to improve the withstand voltage characteristic of the cathode ray tube. However, even when a high voltage is applied to the tube in which the inner wall of the neck is coated with a high-resistance film having a resistance-temperature characteristic, a spark or a leakage current not resulting in a spark is generated, so the spot knocking processing cannot be well performed. Consequently, the obtained cathode ray tube has no satisfactory reliability.

FIG. 4 is a graph showing the relationship between the neck temperature and the leakage current from a focusing electrode in a conventional tube in which a $Cr_2O_3$ film is formed as a high-resistance film on the inner wall of the neck. As shown in FIG. 4, the leakage current abruptly increases when the neck temperature exceeds about 65° C. The reason for this is considered as follows. That is, as the neck temperature rises, the electrical resistance of the high-resistance film lowers, and the neck potential rises accordingly. This increases the intensity of the electric field concentrated from the neck inner wall to the focusing electrode. As a consequence, the field emission current of electrons from the electrode increases.

The abrupt increase in the leakage current at high temperatures is probably due to failure in maintaining the withstand voltage characteristic of the tube at high neck potentials. More specifically, the neck temperature during spot knocking is lower than the maximum neck temperature when the tube is in operation, although the neck temperature also depends upon the outside air temperature and some other conditions. For example, when spot knocking processing is performed at 25° C., the resistance of the high-resistance film is approximately $2\times10^{13}\Omega$ as shown in FIG. 2. On the other hand, the neck temperature rises to about 65° C. when the tube is in operation, although it also depends upon other conditions. At that time, the resistance of the high-resistance film is approximately $1.4\times10^{12}\Omega$ as shown in FIG. 2; the resistance of the high-resistance film lowers by about 93%. As described above, although the spot knocking processing is performed with a high film resistance, the film resistance lowers while the tube is operating, and this increases the neck inner wall potential. Presumably, when the neck potential rises, the withstand voltage characteristic of the tube cannot be maintained any longer, and this generates a spark or a leakage current not resulting in a spark when the tube is in operation.

While the tube is operating, the neck temperature rises to about 45° C. when the outside air temperature is 25° C. If the outside air temperature is high or heat radiation around the tube is insufficient, the neck temperature can rise to 65° C. or higher. For example, when the leakage current exceeds 0.3 $\mu$A, the focusing characteristic of the tube obviously deteriorates. Even if a leakage current smaller than that value flows, discharge occurs in the tube, and this can destroy electrical circuitry which supplies a voltage or the like to the tube. Furthermore, the reliability of the tube significantly suffers.

According to the experiments conducted by the present inventors as described above, even when neck charging by secondary electrons is prevented by a high-resistance film such as disclosed in the prior arts, if the film resistance of this high-resistance film changes with temperature, a cathode ray tube generates heat to bring about a convergence drift. Therefore, these prior arts cannot completely suppress the convergence drift.

Additionally, a high-resistance film as disclosed in the prior arts has a large temperature coefficient of resistance. Therefore, if the neck temperature rises when the tube is in operation, a leakage current flows. This significantly decreases the reliability of the cathode ray tube.

BRIEF SUMMARY OF THE INVENTION

The present invention has been made in consideration of the drawbacks and problems of the above prior arts and has as its object to provide a color cathode ray tube which does not cause color misregistration due to a convergence drift and has high reliability.

The present invention provides a color cathode ray tube comprising an envelope including a panel, a funnel, and a neck, an internal conductive film formed on a region ranging from an inner wall of the funnel to an inner wall of the neck, and an in-line electron gun arranged inside the neck and having a cathode provided in an end portion of the neck and a plurality of grids sequentially arranged from the cathode with gaps by which electron lenses can be formed, wherein a high-resistance film with an electrical resistance higher than an electrical resistance of the internal conductive film is formed on the inner wall of the neck so as to be in contact with the internal conductive film, and a resistance R(T) across the high-resistance film in a tube axial direction at a temperature T(°C.) has a resistance-temperature characteristic represented by $$d\,(\mathrm{Log}\,R(T))/dT \geqq -0.01$$

where Log is the common logarithm at least at a temperature ranging from 20° C. to 40° C., and is approximately $5\times10^{13}\Omega$ or less at about 25° C.

In the present invention, neck potential variations caused by secondary electrons or heat can be suppressed without impairing the reliability of the cathode ray tube, and a convergence drift can be completely prevented. Additionally, it is possible to provide a high-performance, high-reliability color cathode ray tube which does not cause an intratube spark or a leakage current and is free of color misregistration.

Also, in the present invention, the generation of secondary electrons is suppressed and a rise in the neck potential is prevented by controlling the change in the electrical resistance of the high-resistance film, that arises from a temperature change. Consequently, a cathode ray tube free of color misregistration due to a convergence drift can be obtained.

Furthermore, in the present invention, a rise in the neck potential and the subsequent generation of a leakage current are prevented by controlling the change in the electrical resistance of the high-resistance film, that arises from a temperature change, so spot knocking processing can be well performed. Consequently, a color cathode ray tube with high reliability can be obtained.

Additional objects and advantages of the invention will be set forth in the description which follows, and in part will be obvious from the description, or may be learned by practice of the invention. The objects and advantages of the invention may be realized and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

The present invention provides a color cathode ray tube comprising an envelope including a panel, a funnel, and a neck, an internal conductive film formed on a region ranging from an inner wall of the funnel to an inner wall of the neck, and an in-line electron gun arranged inside the neck and having a cathode provided in an end portion of the neck and a plurality of grids sequentially arranged from the cathode with gaps by which electron lenses can be formed, wherein a high-resistance film with an electrical resistance higher than an electrical resistance of the internal conductive film is formed on the inner wall of the neck so as to be in contact with the internal conductive film, and a resistance R(T) across the high-resistance film in a tube axial direction at a temperature T(°C) has a resistance-temperature characteristic represented by $$d\,(\mathrm{Log}\,R(T))/dT \geqq -0.01$$

where Log is the common logarithm at least at a temperature ranging from 20° C. to 40° C., and is approximately $5\times10^{13}\Omega$ or less at about 25° C.

It is preferable that the resistance of the high-resistance film be approximately $1\times10^{10}\Omega$ or more within the range of an operating temperature of the cathode ray tube.

It is also preferable that the high-resistance film be formed from a position where the high-resistance film is in contact with the internal conductive film to at least a portion of an inner wall surrounding a space between a farthest grid and a second farthest grid from the cathode.

Figure 5:
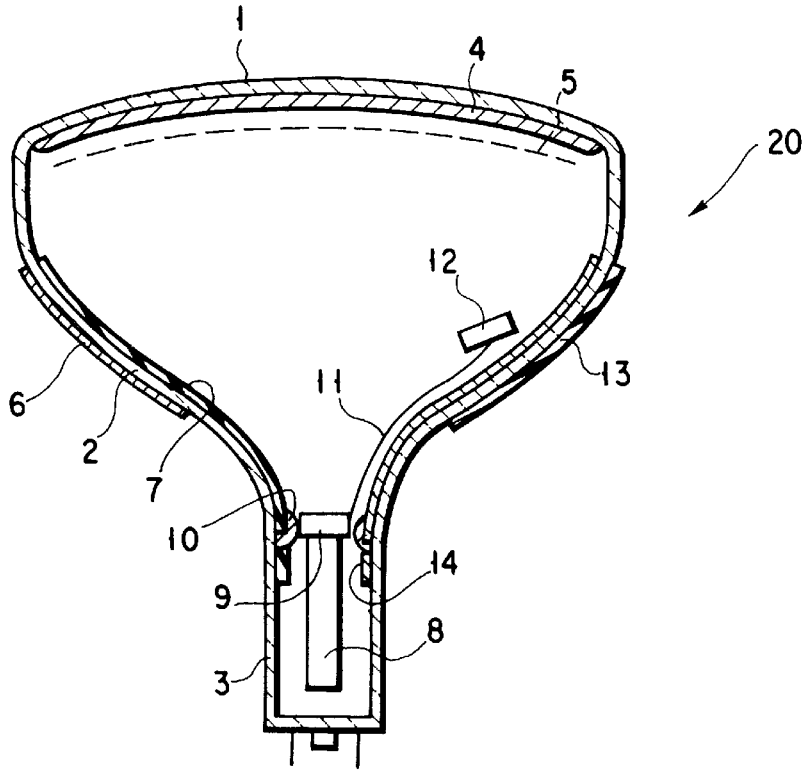
FIG. 5 is a schematic view showing one example of a cathode ray tube according to the present invention.

FIG. 5 is a schematic view showing an example of the color cathode ray tube according to the present invention. As shown in FIG. 5, a general color cathode ray tube 20 has an envelope including a panel 1, a funnel 2, and a neck 3. A fluorescent or phosphor screen 4 is adhered to the inner surface of the panel 1 in this envelope. The fluorescent screen 4 is composed of fluorescent or phosphor layers, which are formed by adhesion into the form of stripes or dots and emit red, green, and blue light, and a metal back layer. A shadow mask 5 is arranged to oppose the fluorescent screen 4 with a predetermined spacing between them. In addition, an internal conductive film 7 conducting to an anode terminal 6 formed on the funnel 2 is formed by adhesion on the inner surface from the funnel 2 to the neck 3. A getter 12 and a getter support 11 are also formed.

An electron gun 8 is incorporated into the neck 3. A convergence electrode 9 of this electron gun 8 is so formed that a valve spacer 10 conductively contacts the internal conductive film 7. Furthermore, an external conductive film 13 is formed on the outer wall of the funnel 2.

A high-resistance film 14 with an electrical resistance higher than that of the internal conductive film 7 is formed on the inner wall of the neck 3 so as to be in contact with the internal conductive film 7.

Assuming that the resistance across the high-resistance film 14 in the axial direction of the tube at a temperature T(°C.) is R(T), the high-resistance film 14 has a resistance-temperature characteristic represented by $$d\,(\mathrm{Log}\,R(T))/dT \geqq -0.01$$

where Log is the common logarithm at least at a temperature ranging from 20° C. to 40° C.

The resistance is approximately $5\times10^{13}\Omega$ or less at about 25° C. and approximately $1\times10^{10}\Omega$ more within the range of the operating temperature of the cathode ray tube.

Figure 6:
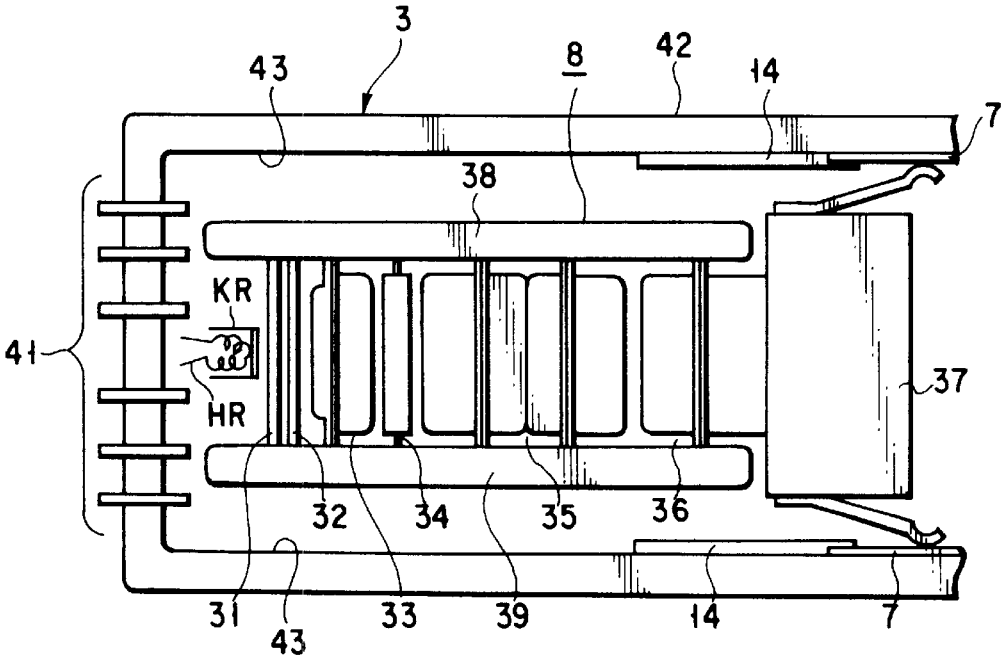
FIG. 6 is an enlarged view of a neck portion in FIG. 5.

FIG. 6 is an enlarged view of the neck 3.

As shown in FIG. 6, an end portion region of the neck 3 incorporates a cathode KR, cathodes KG and KB (not shown), a heater HR, and heaters HG and HB (not shown). In a direction from the cathode to the neck, a first electrode (grid) 31, a second electrode (grid) 32, a third electrode (grid) 33, a fourth electrode (grid) 34, a fifth electrode (grid) 35 as a focusing electrode, a sixth electrode (grid) 36 as a final accelerating electrode, and a shield cup 37 are arranged in this order. The electrodes except for the shield cup 37 are spaced at predetermined intervals so as to form electron lenses. All of these electrodes extend from two insulating supports 38 and 39 and are fixed and supported at the same time. The shield cup 37 is fixed by welding to the sixth electrode 36.

One nearly circular aperture is formed to correspond to one cathode in each of the first electrode 31 to the sixth electrode 36. Small apertures 1 mm or less in diameter are formed in the first electrode 31 and the second electrode 32. On the side of the third electrode 33 facing the second electrode 32, an aperture about 2 mm in diameter, i.e., an aperture larger than the aperture in the second electrode 32 is formed. Comparatively large apertures about 5 to 6 mm in diameter are formed from the side of the third electrode 33 facing the fourth electrode 34 to the sixth electrode 36.

This electron gun 8 is sealed in the cylindrical neck 3 about 20 to 40 mm in diameter in the rear portion of a picture tube and supported by stem pins 41 provided in the rear end portion of the neck. A predetermined voltage is externally supplied to the electrodes except for the sixth electrode 36 via these stem pins 41.

In this arrangement, a voltage obtained superposing a video signal corresponding to an image on a DC voltage of about 150V is applied to, e.g., the cathodes KR, KG, and KB. The first electrode 31 is grounded. The second electrode 32 is connected to the fourth electrode 34 in the tube, and a DC voltage of about 800V is applied to the second electrode 32. The third electrode 33 is connected to the fifth electrode 35 as a main focusing electrode in the tube, and a DC voltage of about 6 to 9 kV is applied to the third electrode 33. A high anode voltage of about 30 kV is applied to the shield cup 37 of the sixth electrode 36 via the internal conductive film 7 formed on a neck inner wall 43.

Electron beams emitted from the cathodes KR, KG, and KB form a crossover near the second electrode 32 and the third electrode 33 and diverge. These electron beams are preliminarily focused by a pre-focusing lens formed by the second electrode 32 and the third electrode 33 and further preliminarily focused by an auxiliary lens formed by the fourth electrode 34 and the fifth electrode 35. Thereafter, the electron beams finally form beam spots on the screen through a main lens formed by the fifth electrode 35 and the sixth electrode 36.

The internal conductive film 7 formed on the neck inner wall 43 is formed in the tube axial direction to a middle portion of the shield cup 37. The high-resistance film 14 is formed on the neck inner wall so as to be connected to the internal conductive film 7 and to cover the subsequent sixth electrode 36 and the end face of the fifth electrode 35, that opposes the sixth electrode 36. A glass substrate is directly exposed to the neck inner wall from the end portion of this high-resistance film 14 to the stem pins 41.

A CR integrating circuit is constituted by the resistance and the stray capacitance of the high-resistance film 14 and neck glass 42. By the high anode voltage supplied by the internal conductive film 7, the potential of the high-resistance film 14 stabilizes at a certain potential determined by the resistance and the stray capacitance of the high resistance film 14 and the neck glass 42.

Accordingly, the lower the resistance of the high-resistance film 14, the faster the potential of the high-resistance film 14 stabilizes. However, if the resistance is too low, a leak is produced between the high-resistance film 14 and the fifth electrode 35, and this deteriorates the withstand voltage characteristic. Therefore, the resistance of the high-resistance film 14 is set at $10^{10}$ to $10^{14}\Omega$.

Variations in the neck inner wall potential penetrate through the gaps between the individual electrodes for forming the electron lenses of the electron gun, and this changes the trajectories of side beams. The main lens formed by the fifth electrode 35 and the sixth electrode 36 has the widest interelectrode gap and is close to the internal conductive film 7. Therefore, the main lens is readily influenced by the neck inner wall potential which is charged up to a comparatively high potential. For this reason, the trajectory change is largest in the main lens formed by the fifth electrode 35 and the sixth electrode 36. Accordingly, the high-resistance film 14 is formed to extend to at least a portion of the inner wall surrounding the gap between the sixth electrode 36 and the fifth electrode 35 or the end of the sixth electrode which together form the main lens and are farthest and second farthest, respectively, from the cathode. Consequently, it is possible to stabilize the neck potential near the main lens, which is charged up by the high anode voltage, within a short time period and converge changes in the trajectories of side beams within a short time period.

Figure 7:
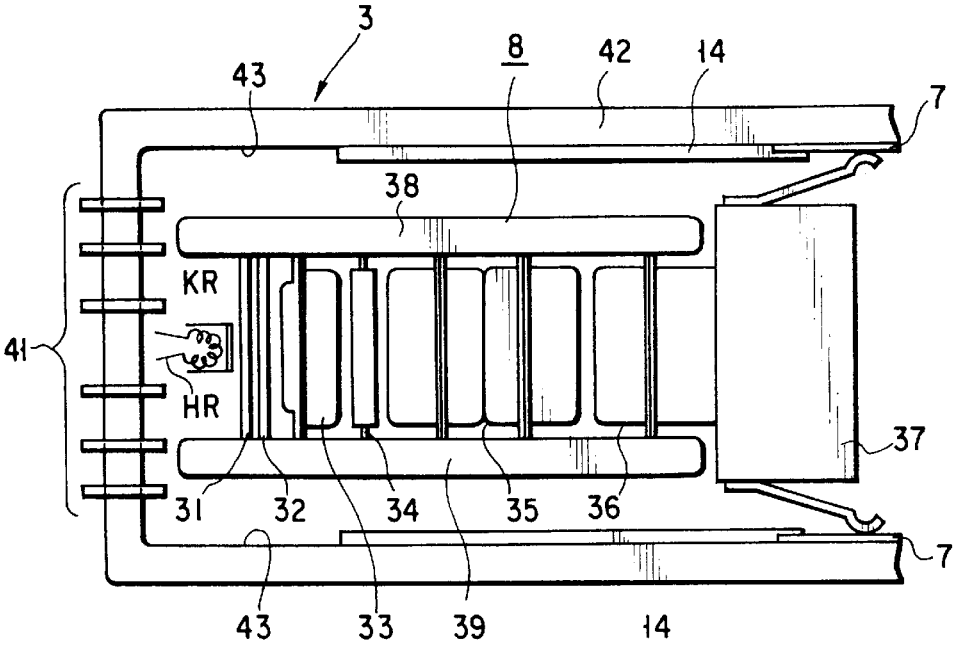
FIG. 7 is a view showing another example of a high-resistance film used in the present invention.
Figure 8:
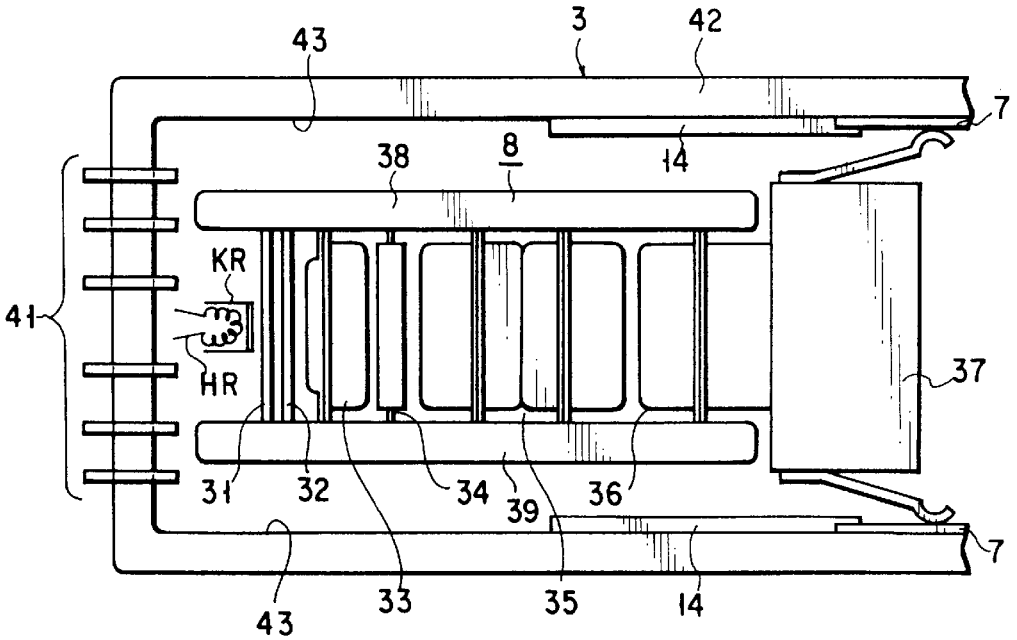
FIG. 8 is a view showing still another example of a high-resistance film used in the present invention.

FIGS. 7 and 8 are views showing other examples of high-resistance films used in the present invention.

In the neck portion shown in FIG. 6, the high-resistance film 14 on the inner wall is formed from the position where the high-resistance film 14 is in contact with the internal conductive film 7 to a portion of the inner wall surrounding the gap between the sixth and fifth electrodes. In FIG. 7, instead of the high-resistance film 14, a high-resistance film 14 is formed to extend to the inner wall surrounding the space between the third and fourth electrodes. In FIG. 8, instead of the high-resistance film 14, a high-resistance film 14 is formed from a position where the high-resistance film 14 is in contact with the internal conductive film 7 so as to cover the entire inner wall surrounding the space between the sixth and fifth electrodes and middle to the fifth electrode.

A change in the resistance of a high-resistance film with temperature depends upon the initial temperature and the initial resistance. However, a resistance R(T) across a conventional $Cr_2O_3$ film in the axial direction of a tube at a temperature T(°C) has a temperature characteristic substantially represented by $d(\log R(T))/dT=-0.035$. When the neck temperature changes by about 15° C., the resistance reduces by about 70%. At that time, the convergence changes by about 0.25 mm.

The allowable change amount of the convergence, however, is substantially 0.1 mm. To obtain this value, the reduction ratio of the resistance must be decreased to about 35% or less.

The resistance R(T) at the temperature T(°C.) of the high-resistance film of the present invention has a temperature characteristic represented by $d(\log R(T))/dt \geqq -0.01$. Accordingly, the change ratio of the resistance is 35% or less which is nearly within the allowable change of the convergence.

On the other hand, if the resistance of the high-resistance film is larger than approximately $5\times10^{13}\Omega$ at room temperature (about 25° C.), the neck potential changes due to secondary electrons, so the convergence cannot be prevented. Therefore, the upper limit of the film resistance of the high-resistance film is approximately $5\times10^{13}\Omega$.

Also, if the neck temperature rises while the cathode ray tube is in operation and the resistance of the high-resistance film becomes smaller than about $1\times10^{10}\Omega$, an intratube spark occurs or a leakage current flows, and this tends to bring about focusing deterioration. In the preferred mode of the present invention, however, the film resistance is not more than about $5\times10^{13}\Omega$ at room temperature (25° C.) and about $1\times10^{10}\Omega$ or more even while the tube is operating. As a consequence, a convergence drift can be prevented. Additionally, even if the neck temperature rises, no spark occurs, or a leakage current not resulting in a spark does not easily flow.

The present invention will be described in more detail below by way of its practical examples.

Figure 9:
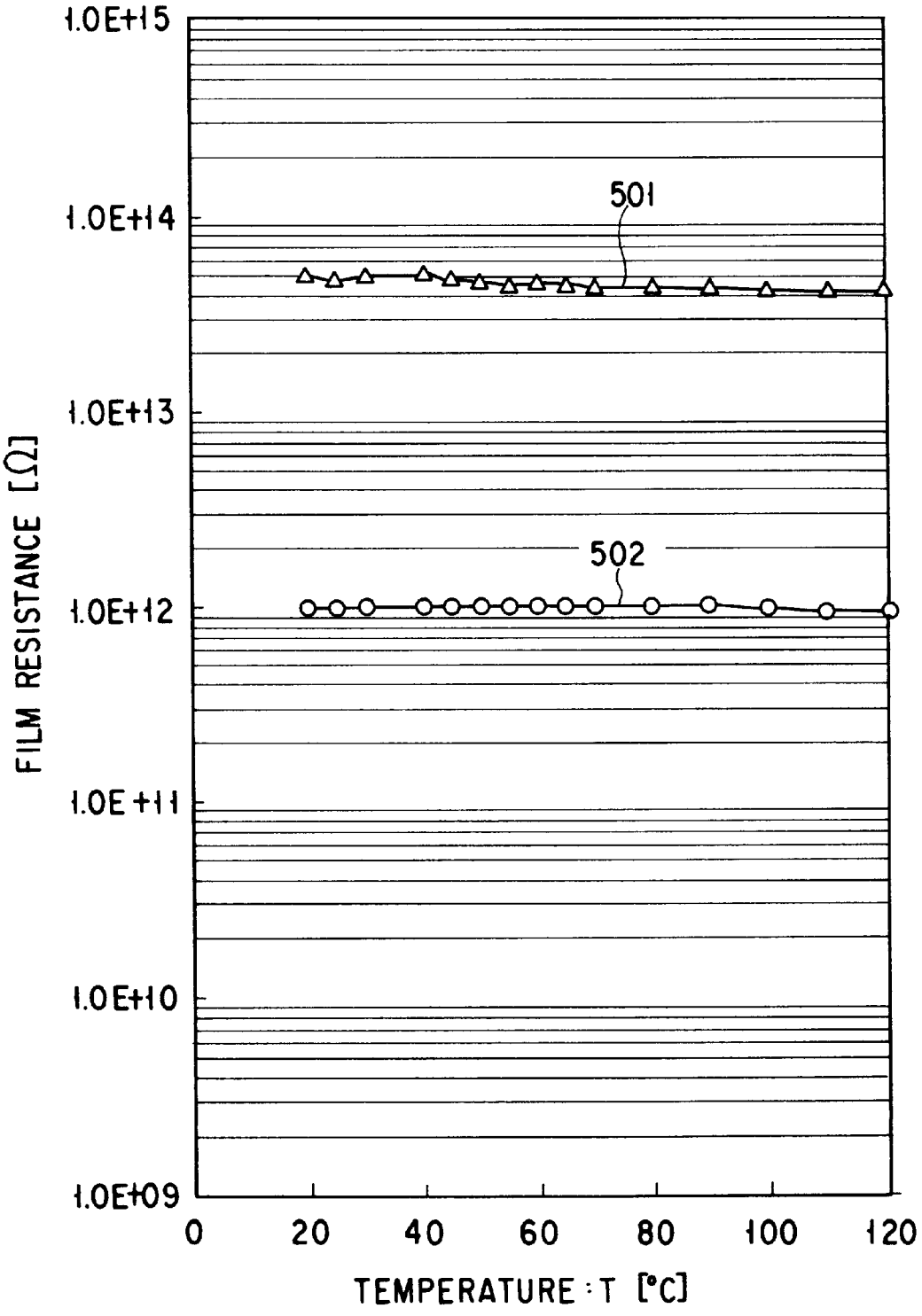
FIG. 9 is a graph showing the resistance-temperature characteristics of examples of high-resistance films used in the present invention.

FIG. 9 is a graph showing the resistance-temperature characteristics of examples of high-resistance films used in the present invention. In FIG. 9, curves 501 and 502 indicate representative examples of high-resistance films formed by using fine particles of tin oxide and silicon oxide as a binder. The inner wall of a neck having an outer diameter of 22.5 mm (inner diameter=about 19.5 mm) was coated with these high-resistance films about 15 mm in length along the axial direction of a tube. The resistance-temperature characteristics of the films in a vacuum of $10^{-3}$ Torr or less were measured.

Figure 1:
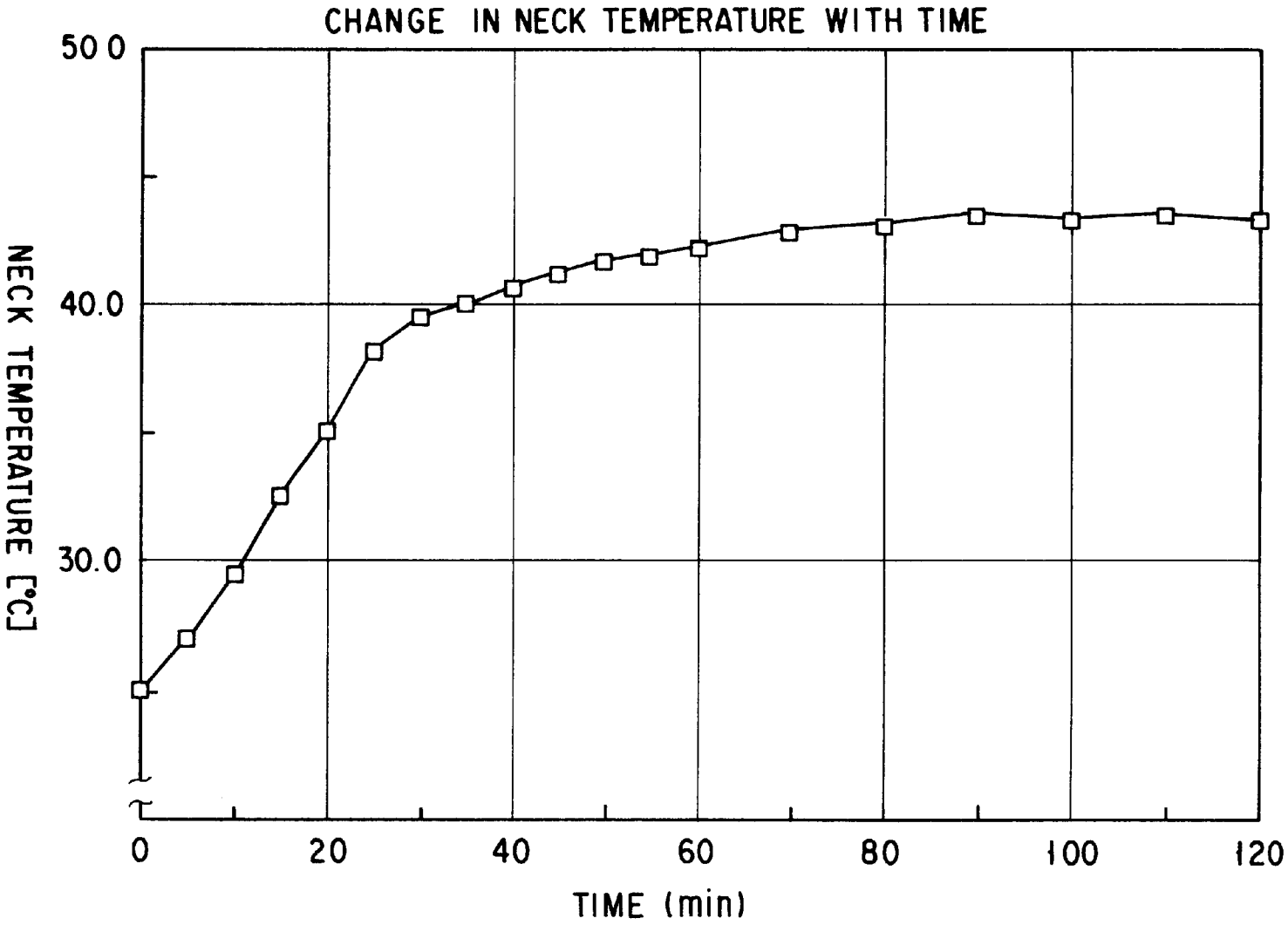
FIG. 1 is a graph showing a change in the neck outer wall temperature of a cathode ray tube with time.
Figure 2:
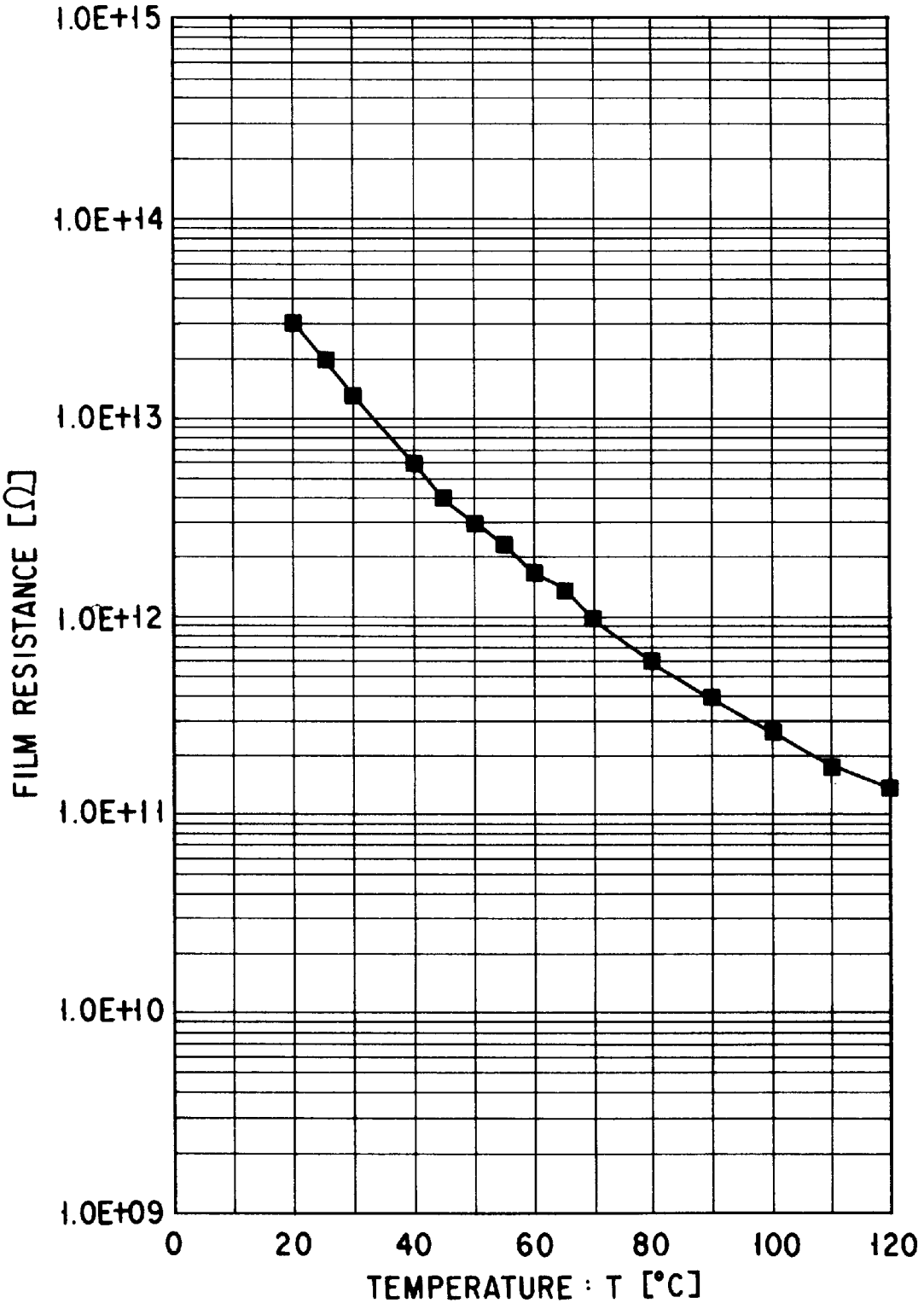
FIG. 2 is a graph showing the resistance-temperature characteristic of a conventional high-resistance film.
Figure 3:
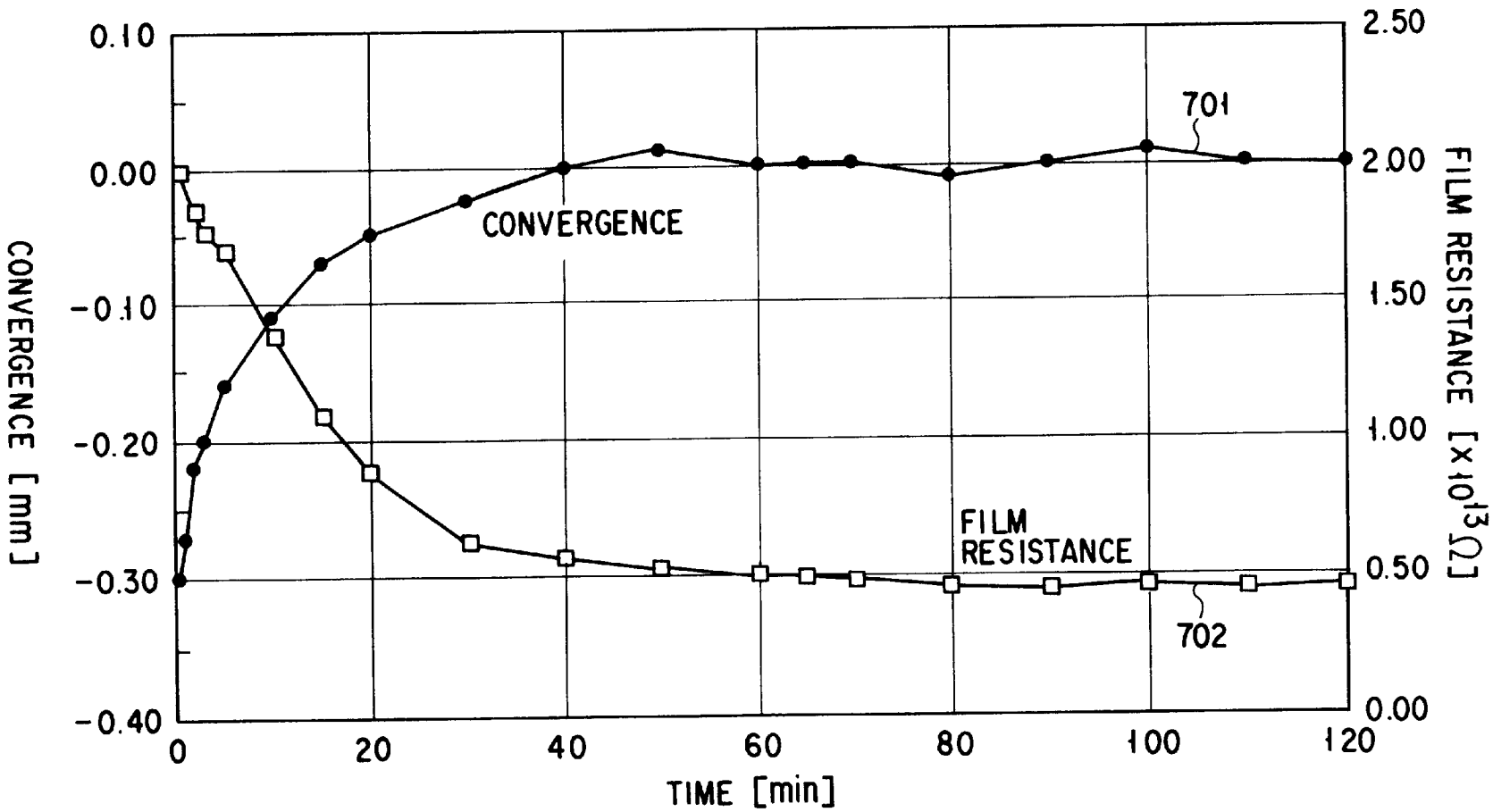
FIG. 3 is a graph showing the convergence drift characteristic of a cathode ray tube using a conventional high-resistance film and a change in the electrical resistance of the high-resistance film used with time.
Figure 4:
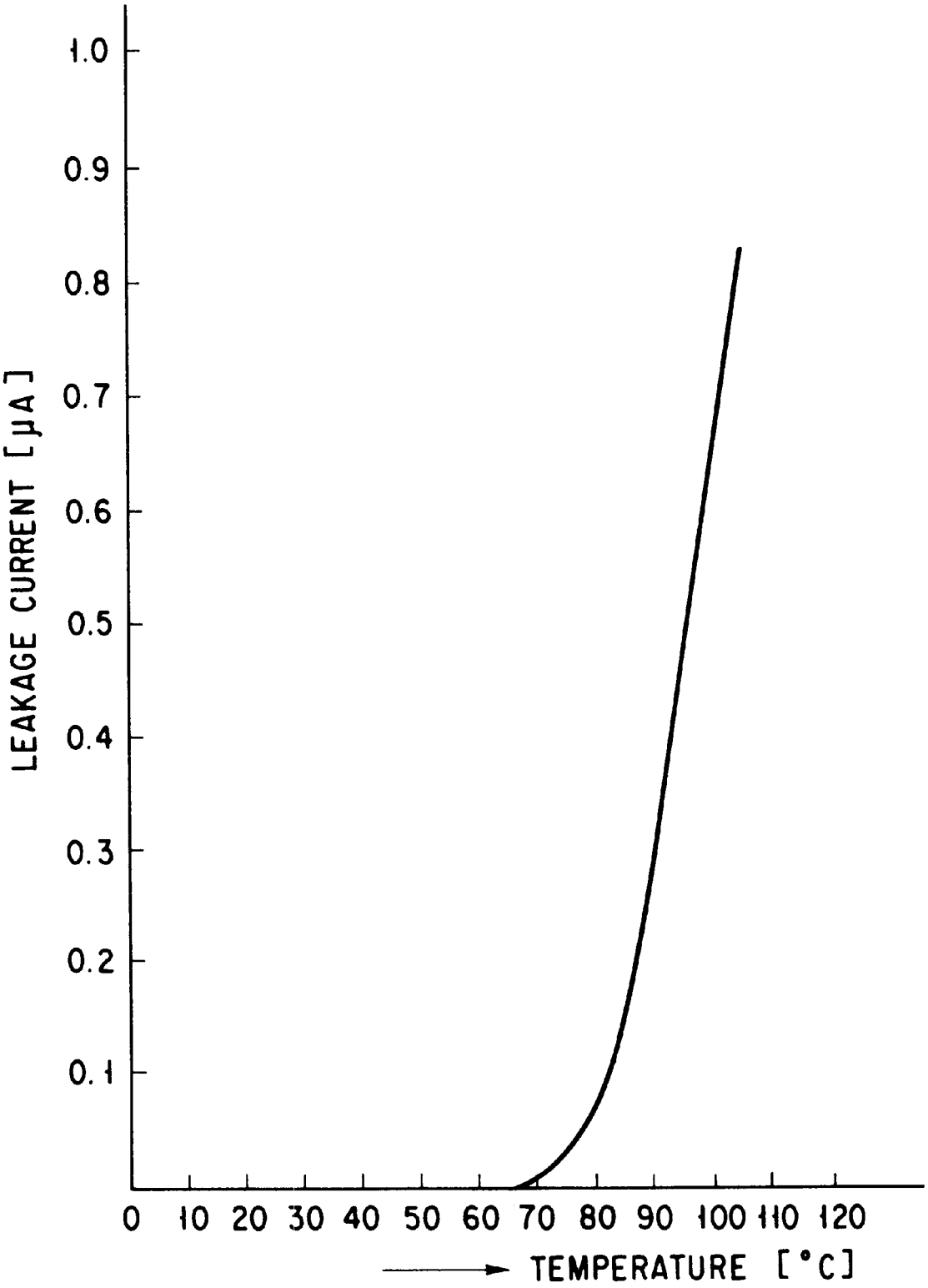
FIG. 4 is a graph showing the relationship between the neck temperature and the leakage current from a focusing electrode in a cathode ray tube using a conventional high-resistance film.

As shown in FIG. 9, the temperature dependence of resistance of each high-resistance film containing tin oxide as a conductive substance is much smaller than the temperature dependence of resistance of a $Cr_2O_3$ film as a conventional high-resistance film as shown in FIG. 2.

This high-resistance film was formed by dispersing conductive tin oxide fine particles and a silane coupling agent such as ethyl silicate serving as a binder in an organic solvent such as ethyl alcohol, coating the inner wall of a neck with the resultant solution by spraying or dipping, and baking the solution film at about 450° C. The film resistances indicated by the curves 501 and 502 were adjusted by changing the concentration of the conductive tin oxide particles, the concentration of the ethyl silicate, the coating method, and the coating conditions.

Figure 10:
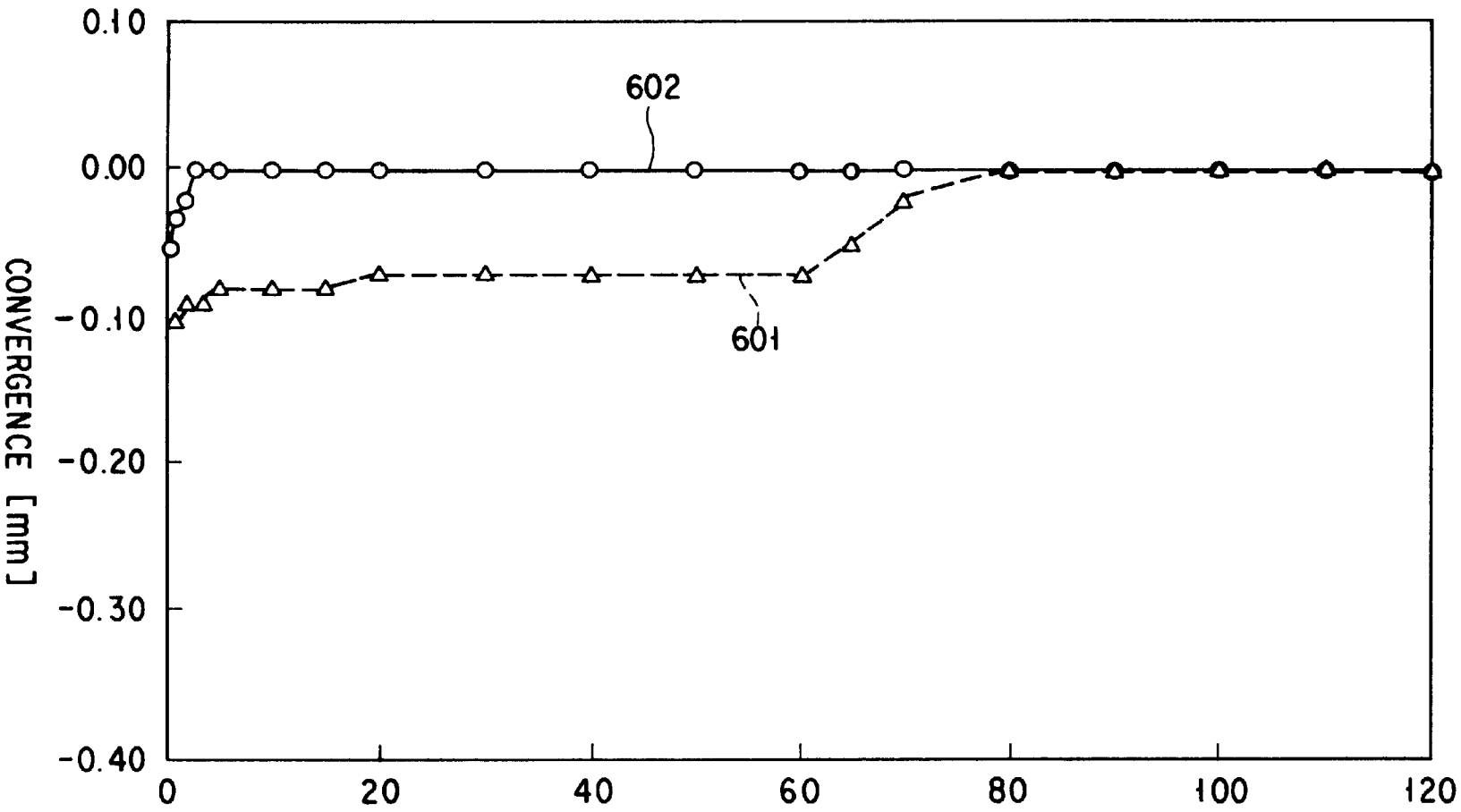
FIG. 10 is a graph showing the convergence drift characteristics of examples of color cathode ray tubes according to the present invention.

FIG. 10 is a graph showing the convergence drift characteristics of examples of color cathode ray tubes according to the present invention. In FIG. 10, curves 601 and 602 indicate the convergence drift characteristics obtained when the inner wall of a neck of a 15" color display tube having a neck outer diameter of 22.5 mm (inner diameter=19.5 mm) was coated with the high-resistance films having the resistance-temperature characteristics represented by the curves 501 and 502, respectively, in FIG. 9.

Each tin oxide high-resistance film was formed with a length of about 15 mm in the tube axial direction so as to cover the gaps between grids for forming a main focusing electron lens of an electron gun. The measurement conditions were the same as in the method described in the explanation of the prior arts, so a detailed description thereof will be omitted.

The characteristic 601 in FIG. 10 was obtained when the film resistance at 25° C. was approximately $5\times10^{13}\Omega$. As shown in FIG. 10, the convergence was about −0.1 mm immediately after the measurement was started, became about −0.07 mm in about twenty minutes, and stabilized at this value until sixty minutes elapsed. After the elapse of sixty minutes at which a high electron beam current was started to be supplied, the convergence drifted in the direction of under convergence. In about eighty minutes, the convergence converged to 0 mm and stabilized at this value. The convergence drift amount was about 0.1 mm within the allowable range.

This characteristic shows that when the film resistance is higher than about $5\times10^{13}\Omega$, the neck potential changes due to the influence of secondary electrons, and the convergence drift exceeds the allowance.

The characteristic 602 in FIG. 10 was obtained when the film resistance at 25° C. was approximately $1\times10^{13}\Omega$. The convergence was about −0.05 mm immediately after the measurement was started, converged to 0 mm in about three minutes, and remained unchanged thereafter.

This characteristic demonstrates that when the film resistance is approximately $1\times10^{12}\Omega$, there is no influence of secondary electrons, and the neck potential does not change. However, although the film resistance had almost no temperature dependence, the convergence changed within a short time period of about three minutes immediately after the operation was started. Presently, this phenomenon is not well explicated.

In the present invention as described above, a convergence drift caused by heat can be nearly completely prevented by the use of a film whose resistance has small temperature dependence. However, if the film resistance is higher than about $5\times10^{13}\Omega$, a convergence drift is caused by secondary electrons.

Also, the resistance-temperature characteristic of the high-resistance film used in the present invention is approximately $d(\log R(T))/dT \geqq -0.01$. Since the temperature coefficient of resistance of the high-resistance film used is thus small, the potential of the neck inner wall remains almost unchanged even if the neck temperature rises while the cathode ray tube is operating in spot knocking processing. Therefore, the withstand voltage characteristic of the cathode ray tube does not deteriorate during the spot knocking processing of the cathode ray tube. This is so because even when spot knocking is performed at 25° C. and the neck temperature rises to about 65° C. during the operation of the cathode ray tube, the film resistance decreases only by 40%, so a rise in the neck inner wall potential is extremely small.

Additionally, if the film resistance is low, a spark or a leakage current not resulting in a spark occurs in the cathode ray tube. This impairs the reliability of the tube.

Table 1 shows the results of evaluation of, e.g., focusing deterioration caused by an intratube spark or a leakage current when cathode ray tubes coated with tin oxide high-resistance films having different film resistances were used.

TABLE 1

| Film resistance of tin oxide (about 25° C.) | Evaluation of withstand voltage |
|---|---|
| $5\times10^{13}\Omega$ | Good |
| $1\times10^{12}\Omega$ | Good |
| $5\times10^{11}\Omega$ | Good |
| $3\times10^{10}\Omega$ | Good |
| $1\times10^{10}\Omega$ | Focusing deteriorated |
| $6\times10^{9}\Omega$ | Spark was found, focusing deteriorated |

When the film resistance is lower than $1\times10^{10}\Omega$, an intratube spark or focusing deterioration occurs during operation. Accordingly, the lower limit of the film resistance is about $1\times10^{10}\Omega$. However, if the neck temperature rises and the resistance of the high-resistance film lowers while the tube is in operation, the maximum neck temperature of the tube in operation must not be lower than about $1\times10^{10}\Omega$. For example, when the maximum neck temperature of the tube is about 100° C. and the temperature dependence of the high-resistance film is represented by $d(\log R(T))/dT=-0.01$ assuming that the resistance at a temperature T(°C.) is R(T), the lower-limiting value of the film resistance at room temperature (about 25° C.) must be approximately $6\times10^{10}\Omega$.

In the present invention as has been described above, assuming that the resistance across the high-resistance film in the axial direction of a tube at a temperature T(°C.) is R(T), this resistance R(T) has a resistance-temperature characteristic represented by $$d\,(\mathrm{Log}\,R(T))/dT \geqq -0.01$$

where Log is the common logarithm at least at a temperature ranging from 20° C. to 40° C. Also, the resistance of the high-resistance film at room temperature (about 25° C.) is approximately $5\times10^{13}\Omega$ less. By the use of this high-resistance film, it is possible to suppress neck potential variations resulting from secondary electrons or heat and sufficiently prevent a convergence drift. Furthermore, in the present invention the resistance of the high-resistance film is set to approximately $1\times10^{10}\Omega$ or more within the range of the operating temperature of a cathode ray tube while the tube is in operation. Therefore, it is possible to provide a high-performance, high-reliability color cathode ray tube which does not cause an intratube spark or a leakage current and is free of color misregistration.

In the embodiment, the high-resistance film was formed by dispersing conductive tin oxide fine particles and a silane coupling agent such as ethyl silicate serving as a binder in an organic solvent such as ethyl alcohol, coating the inner wall of a neck with the resultant solution by spraying or dipping, and baking the solution film at about 450° C. However, the present invention is not limited to this embodiment and can be applied to a case in which a high-resistance film formed by using another conductive substance or dispersion solution component or formed under different film formation conditions is used. For example, antimony or indium can be added to the solution described above. The resistance of the high-resistance film can be changed by changing the film formation conditions. Furthermore, the high-resistance film used in the present invention is well applicable to color cathode ray tubes of sizes other than a 15" color display tube having a neck outer diameter of 22.5 mm (inner diameter=about 19.5 mm). Also, the length of the high-resistance film in the tube axial direction is not limited to 15 mm.

Additional advantages and modifications will readily occur to those skilled in the art. Therefore, the invention in its broader aspects is not limited to the specific details and representative embodiments shown and described herein. Accordingly, various modifications may be made without departing from the spirit of scope of the general inventive concept as defined by the appended claims and their equivalents.

We claim:

1. A color cathode ray tube comprising an envelope including a panel, a funnel, and a neck, an internal conductive film formed on a region ranging from an inner wall of said funnel to an inner wall of said neck, and an in-line electron gun arranged inside said neck and having a cathode provided in an end portion of said neck and a plurality of grids sequentially arranged from said cathode with gaps by which electron lenses can be formed, wherein a high-resistance film with an electrical resistance higher than an electrical resistance of said internal conductive film is formed on the inner wall of said neck so as to be in contact with said internal conductive film, and a resistance R(T) across said high-resistance film in a tube axial direction at a temperature T(°C.) has a resistance-temperature characteristic represented by $$d\,(\mathrm{Log}\,R(T))/dT \geqq -0.01$$

where Log is the common logarithm at least at a temperature ranging from 20° C. to 40° C., and is not more than approximately $5\times10^{13}\Omega$ at about 25° C.

2. A color cathode ray tube according to claim 1, wherein the resistance of said high-resistance film is not less than approximately $1\times10^{10}\Omega$ within the range of an operating temperature of said cathode ray tube.

3. A color cathode ray tube according to claim 1, wherein said high-resistance film is formed to extend from a position where said high-resistance film is in contact with said internal conductive film to at least a portion of an inner wall surrounding a gap between a farthest grid and a second farthest grid from said cathode.

4. A color cathode ray tube according to claim 1, wherein said high-resistance film is formed to extend from a position where said high-resistance film is in contact with said internal conductive film to at least a portion of an inner wall corresponding to a cathode side end of the farthest grid from said cathode.

* * * * *